US009534875B2

(12) United States Patent
Neyer et al.

(10) Patent No.: US 9,534,875 B2
(45) Date of Patent: Jan. 3, 2017

(54) INITIATOR

(75) Inventors: Barry Neyer, Cincinnati, OH (US); Daniel Raymond Knick, Centerville, OH (US); Paul Thomas Moore, Cincinnati, OH (US); Robert Tomasoski, Centerville, OH (US)

(73) Assignee: Excelitas Technologies Corp., Waltham, MA (US)

( * ) Notice: Subject to any disclaimer, the term of this patent is extended or adjusted under 35 U.S.C. 154(b) by 1732 days.

(21) Appl. No.: 11/977,068

(22) Filed: Oct. 23, 2007

(65) Prior Publication Data

US 2010/0282105 A1 Nov. 11, 2010

(51) Int. Cl.
*F42B 3/18* (2006.01)

(52) U.S. Cl.
CPC ..... *F42B 3/18* (2013.01)

(58) Field of Classification Search
USPC ..... 102/202.1, 202.3, 202.4, 202.8, 202.5,102/202.12, 202.14
See application file for complete search history.

(56) References Cited

U.S. PATENT DOCUMENTS 1,704,222 A * 3/1929 Schuricht et al. ..... 102/202.14
3,059,576 A * 10/1962 Haefner ..... 102/202.9
3,227,083 A * 1/1966 Moses et al. ..... 102/202.1
3,257,946 A * 6/1966 Tullio ..... 102/202.8
3,611,939 A * 10/1971 Stadler et al. ..... 102/204
3,804,018 A * 4/1974 Janoski ..... 102/202.4
3,955,505 A * 5/1976 Johnston ..... 102/206
3,971,320 A * 7/1976 Lee ..... 102/202.9
4,103,619 A * 8/1978 Fletcher et al. ..... 361/248
4,291,623 A 9/1981 Robinson et al.
4,577,402 A 3/1986 Swanstrom
4,603,375 A 7/1986 Miller et al.
4,708,062 A 11/1987 Bjork et al.
4,938,137 A 7/1990 Guay
5,140,906 A * 8/1992 Little, II ..... 102/202.14
5,173,570 A * 12/1992 Braun ..... 102/347
5,431,104 A * 7/1995 Barker ..... 102/312
(Continued)

FOREIGN PATENT DOCUMENTS

CA 2132148 A1 3/1996

OTHER PUBLICATIONS

"*Munition Rocket and Missile Motor Ignition System Design, Safety Criteria for Department of Defense*", MIL-STD-1901A, Jun. 6, 2002 (25 pages).

(Continued)

*Primary Examiner* — Jonathan C Weber
(74) *Attorney, Agent, or Firm* — Peter A. Nieves; Sheehan Phinney Bass & Green PA

(57) ABSTRACT

An initiator including a housing adapted to be received in an igniter or rocket motor, at least one charge at a distal end of the housing, an electro-explosive device behind the charge for detonating the charge when subject to a voltage HV, and a pressure bulkhead behind the electro-explosive device. An electronic subsystem in the housing is connected to the electro-explosive device through the bulkhead and includes a lead for providing the voltage HV to the electro-explosive device to initiate it, and a switch in the lead which does not conduct if errant voltages are present on the lead to prevent initiation of the electro-explosive device until the correct voltage HV is present.

11 Claims, 8 Drawing Sheets

(56) References Cited

U.S. PATENT DOCUMENTS

| | | | | |
|---|---|---|---|---|
| 5,436,791 | A * | 7/1995 | Turano et al. | 361/253 |
| 5,444,598 | A * | 8/1995 | Aresco | 361/253 |
| H1476 | H * | 9/1995 | Braun | 102/220 |
| 5,672,841 | A * | 9/1997 | Monk et al. | 102/202.4 |
| 5,754,011 | A * | 5/1998 | Frus et al. | 315/209 SC |
| 5,831,203 | A | 11/1998 | Ewick | |
| 5,969,286 | A | 10/1999 | Ward et al. | |
| 6,034,483 | A * | 3/2000 | Frus et al. | 315/209 CD |
| 6,047,643 | A | 4/2000 | Benner et al. | |
| 6,053,111 | A * | 4/2000 | Motley | 102/313 |
| 6,158,347 | A | 12/2000 | Neyer et al. | |
| 6,166,452 | A * | 12/2000 | Adams et al. | 307/10.1 |
| 6,178,888 | B1 | 1/2001 | Neyer et al. | |
| 6,199,484 | B1 * | 3/2001 | Martinez-Tovar et al. | 102/202.4 |
| 6,230,625 | B1 | 5/2001 | Neyer et al. | |
| 6,234,081 | B1 | 5/2001 | Neyer | |
| 6,353,293 | B1 * | 3/2002 | Frus et al. | 315/209 R |
| 6,386,108 | B1 * | 5/2002 | Brooks et al. | 102/217 |
| 6,467,414 | B1 * | 10/2002 | Fisher | 102/202.4 |
| 6,470,802 | B1 | 10/2002 | Neyer et al. | |
| 6,546,837 | B1 | 4/2003 | Neyer | |
| 6,584,907 | B2 * | 7/2003 | Boucher et al. | 102/217 |
| 6,634,298 | B1 * | 10/2003 | Denney | 102/206 |
| 6,923,122 | B2 * | 8/2005 | Hennings et al. | 102/202.7 |
| 7,095,181 | B2 * | 8/2006 | Frus et al. | 315/209 CD |
| 7,278,658 | B2 * | 10/2007 | Boucher et al. | 280/741 |
| 7,430,963 | B2 * | 10/2008 | Hennings et al. | 102/202.5 |
| 7,549,373 | B2 * | 6/2009 | Brooks et al. | 102/202.7 |
| 7,661,362 | B2 * | 2/2010 | Hennings et al. | 102/202.5 |
| 2002/0101188 | A1 * | 8/2002 | Frus et al. | 315/224 |
| 2003/0075069 | A1 * | 4/2003 | Boucher et al. | 102/217 |
| 2004/0107856 | A1 * | 6/2004 | Hennings et al. | 102/202.7 |
| 2005/0178282 | A1 * | 8/2005 | Brooks et al. | 102/202.7 |
| 2007/0119325 | A1 * | 5/2007 | Hennings et al. | 102/202.9 |
| 2009/0056584 | A1 * | 3/2009 | Hennings et al. | 102/202.5 |

OTHER PUBLICATIONS

Symposium publication entitled "Technology Symposium for High Energy Switches and Electro-Explosive Systems", Aug. 13-15, 1996.

Knick et al., "Electronic Safe and Arming Devices for use with Non-Interrupted Explosive Initiation", AIAA 97-2961 (1997).

U.S. Appl. No. 90/009,651, filed Jan. 14, 2010, Neyer et al.

* cited by examiner

INITIATOR

FIELD OF THE INVENTION

This subject invention relates to an initiator.

BACKGROUND OF THE INVENTION

Initiators are devices including a charge initiated to ignite or begin the burning of a larger main charge or propellant.

Standards such as MIL-STD-1901A include a safety requirement to the effect that an initiator subject to 500 volts due to an errant voltage shall not detonate or deflagrate.

Although various devices for protection against errant voltages are well known, to date those skilled in the art have failed to provide a suitable initiator which meets the 500 volt no deflagration safety requirement. Previous attempts at engineering such a suitable initiator resulted in undue complexity and initiators which are difficult to install or incorporate into existing systems.

BRIEF SUMMARY OF THE INVENTION

It is therefore an object of this invention to provide a new initiator.

It is a further object of this invention to provide such an initiator which meets or exceeds safety requirements or standard such as MIL-STD-1901A.

It is a further object of this invention to provide such an initiator which is fairly simple in design.

It is a further object of this invention to provide such an initiator which does not require any special electronic features such as low inductance cabling or the like.

It is a further object of this invention to provide such an initiator which is easy to install and incorporate into present systems without significant redesign.

It is a further object of this invention to provide such an initiator which is small in size.

The subject invention results from the realization that, in one preferred embodiment, a MIL-STD-1901A compliant high voltage initiator easily fit into existing rocket motors includes circuitry within the initiator housing which does not conduct if a voltage is less than 500 volts is present.

This subject invention features an initiator comprising a housing adapted to be received in an igniter or rocket motor, at least one charge at a distal end of the housing, an electro-explosive device behind the charge for detonating the charge when subject to a voltage HV, and a pressure bulkhead behind the electro-explosive device. An electronic subsystem in the housing is connected to the electro-explosive device through the bulkhead and includes a lead for providing the voltage HV to the electro-explosive device to initiate it. A switch in the lead does not conduct if errant voltages are present on the lead to prevent initiation of the electro-explosive device until the correct voltage HV is present.

The initiator may include two charges in the distal end of the housing. One charge is a pyrotechnic material and the other charge is a detonating material. The pyrotechnic material may include $BKNO_3$ and the detonating material may include HNS-IV.

The typical electro-explosive device is an exploding foil initiator. One possible switch is a spark gap. The electronic subsystem may further include a resistance in series with the spark gap for limiting current, a capacitance charged by a voltage on the lead, and a resistance in parallel with the capacitance.

An initiator in accordance with the subject invention includes a housing adapted to be received in an igniter or rocket motor, at least one charge in the distal end of the housing, an electro-explosive device behind the charge for detonating the charge when subject to a voltage HV, a pressure bulkhead behind the electro-explosive device, and an electronic subsystem in the housing connected to the electro-explosive device through the bulkhead. The preferred electronic subsystem includes a lead for providing the voltage HV to the electro-explosive device to initiate it, and means such as a spark gap device for preventing errant voltages from initiating the electro-explosive device.

One initiator in accordance with the subject invention features at least one charge, an electro-explosive device for detonating the charge when subject to a voltage HV, and an electronic subsystem connected to the electro-explosive device including a lead for providing the voltage HV to the electro-explosive device to initiate it, and a switch in the voltage lead which does not conduct if errant voltages are present on the lead to prevent initiation of the electro-explosive device until the correct voltage HV is present.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
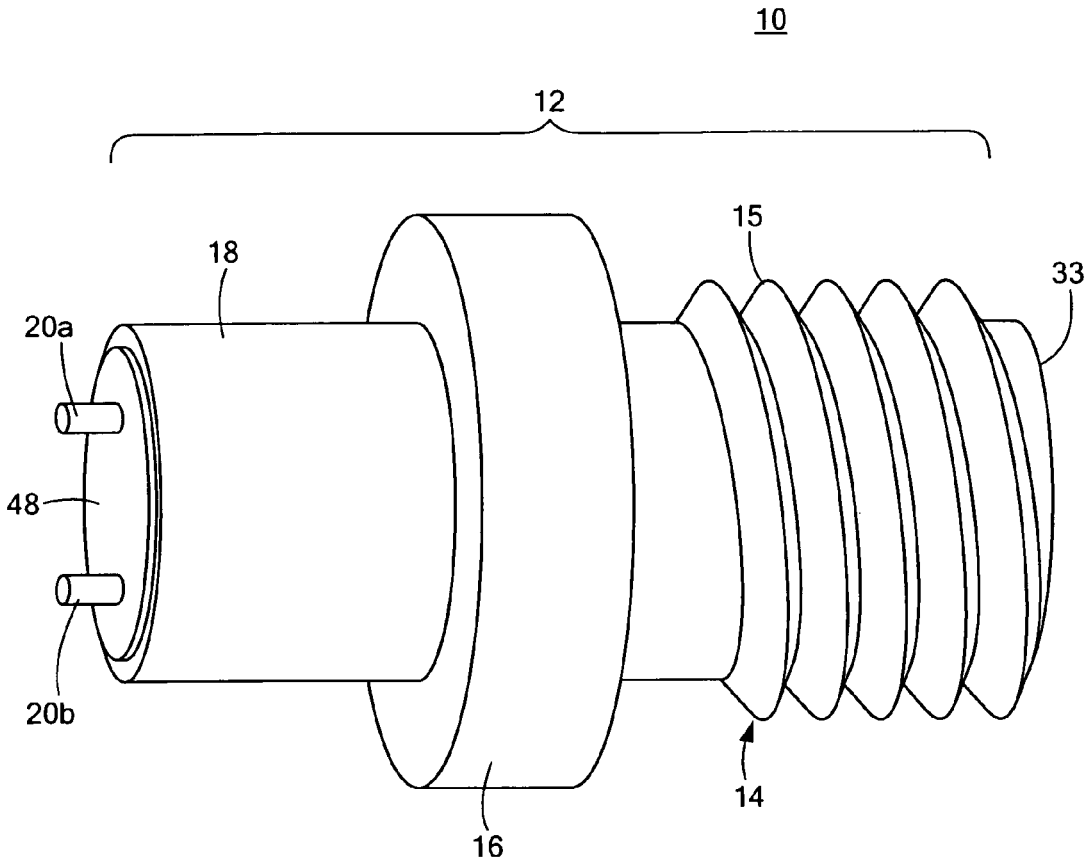
FIG. 1 is a highly schematic three-dimensional side view of an example of an initiator in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Initiator 10, FIG. 1, in one example, includes housing 12 (typically metal) with three sections. Distal charge section 14 (usually including threads 15) is typically received in an igniter itself received in a motor. Or, initiator 10 may include an igniter in which case section 14 would be received in the rocket motor. Pressure bulkhead 16 separates charge section 14 from proximal end electronic section 18 which has leads, such as leads 20*a* and 20*b* (e.g., wire or pins). Initiator 10 is in compliance with MIL-STD-1901A in that if a voltage 500 volts or less is present on leads 20*a* or 20*b*, initiator 10 will not deflagrate as explained below.

Figure 2:
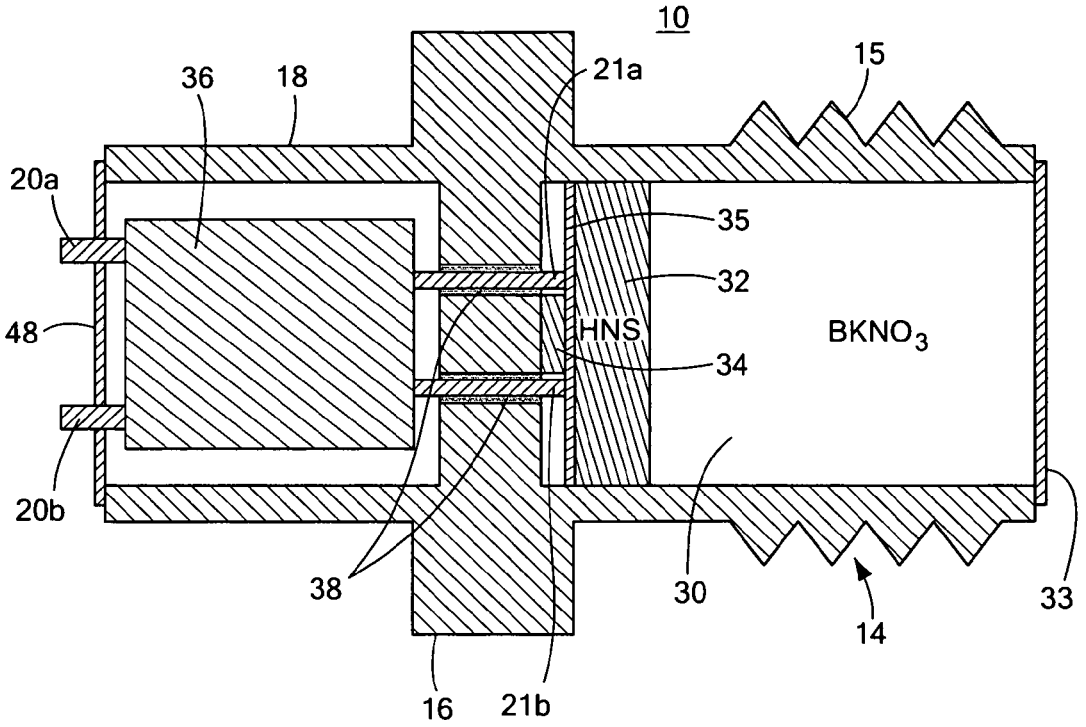
FIG. 2 is a schematic cross-sectional side view of the initiator shown in FIG. 1.

FIG. 2 shows one preferred design of initiator 10. In this example, charge section 14 includes output charge 30 (e.g., a pyrotechnic material such as $BKNO_3$) and detonating charge 32 (an energetic material such as HNS-IV) behind end wall 33. U.S. Pat. No. 6,546,837 by the assignee hereof, incorporated herein by this reference, describes how two such charges can be consolidated, if desired. An electro-explosive device 34 such as an exploding foil initiator ("chip slapper") detonates charge 32 when subject to a high voltage (HV) (e.g. 1200V). U.S. Pat. No. 6,178,888 by the assignee hereof and also incorporated herein by this reference discloses barrel connector 35 which may be used if desired as well as the other components of a preferred exploding foil initiator.

Electronics subsection 36 is behind bulkhead 16 within housing section 18 and is electrically connected to exploding foil initiator 34 via leads 21*a* and 21*b* extending through pressure bulkhead 16. A glass to metal sealing material as shown at 38 may be used to seal leads 21*a* and 21*b* with respect to the metal bulkhead material. Leads 20*a* and 20*b* are electrically connected to electronic subsystem 36 though proximate housing closure disk or end wall 48.

Electronics subsystem 36 includes means such as a switch which does not conduct if errant voltages less than 500 volts are present on lead 20*a*. This feature renders initiator 10 compliant with MIL-STD-1901A. Typically, electronic subsystem 36 includes a circuit board or integrated circuitry for the various circuits and components of the electronics subsystem.

Figure 3:
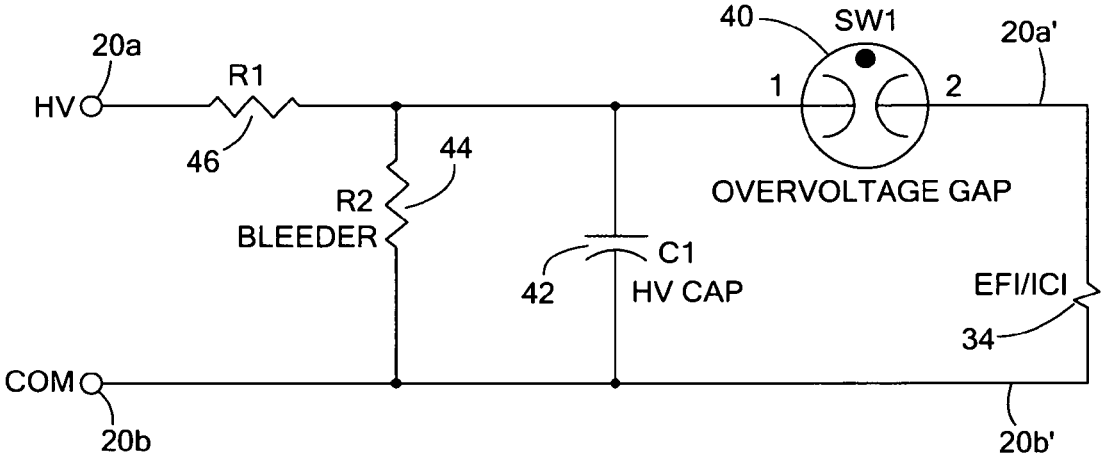
FIG. 3 is a circuit diagram showing an example of an over voltage protection circuit for an initiator in accordance with this invention.

In one example shown in FIG. 3, the switch is a spark gap 40 configured to not conduct if a voltage less than 1,000 volts is present on high voltage lead 20*a*. Any voltage less than this breakdown voltage will charge capacitor 42 (e.g. a 0.1 microfarad capacitor) but will not allow any current to flow to electro-explosive device 34. Moreover, even if spark gap 40 fails so the breakdown voltage is less than 500 volts, resistor 46, FIG. 3 (e.g., 10-100 KO) provides a current limit. As shown, resistor 44 is in parallel with capacitor 42 between high voltage lead 20*a* and common lead 20*b*. Resistor 46 is in series with spark gap 40.

Instead of spark gap 40, a solid state switch could be used, which conducts only when it receives a predetermined voltage level or a signal. A high voltage zener diode could also be used. Other switches and related circuitry are known to those skilled in the art.

Figure 4:
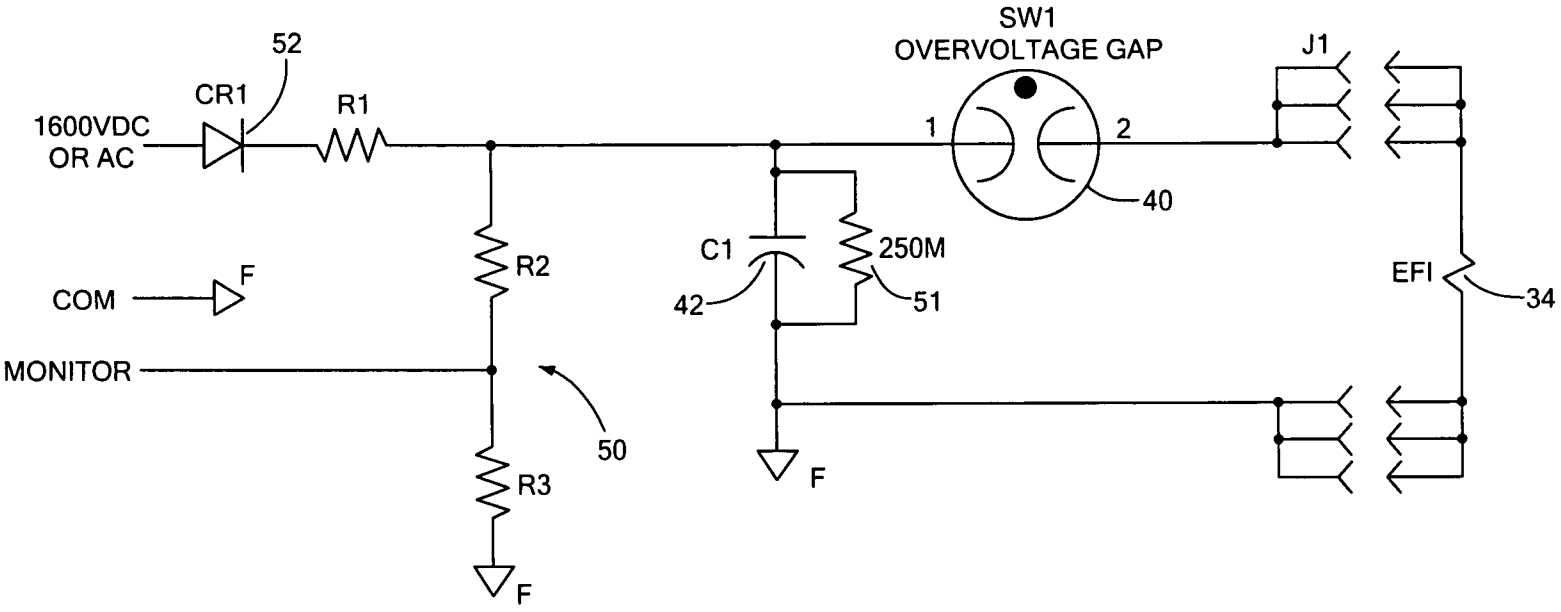
FIGS. 4-7 are circuit diagrams showing examples of other possible over voltage protection circuits for an initiator in accordance with the subject invention.

FIG. 4 shows another configuration of an electronic subsystem with capacitor bleeder resistor 51 that could be printed on the high voltage capacitor. FIG. 4 also shows a resistor divider 50 in parallel with the bleeder resistor that provides redundant bleeding as well as providing a scaled down indication of the charge voltage. Typical for these resistors might be 40 M for R2 and 100 K for R3. FIG. 4 also shows a high voltage diode 52 in-line with the input voltage.

Figure 5:
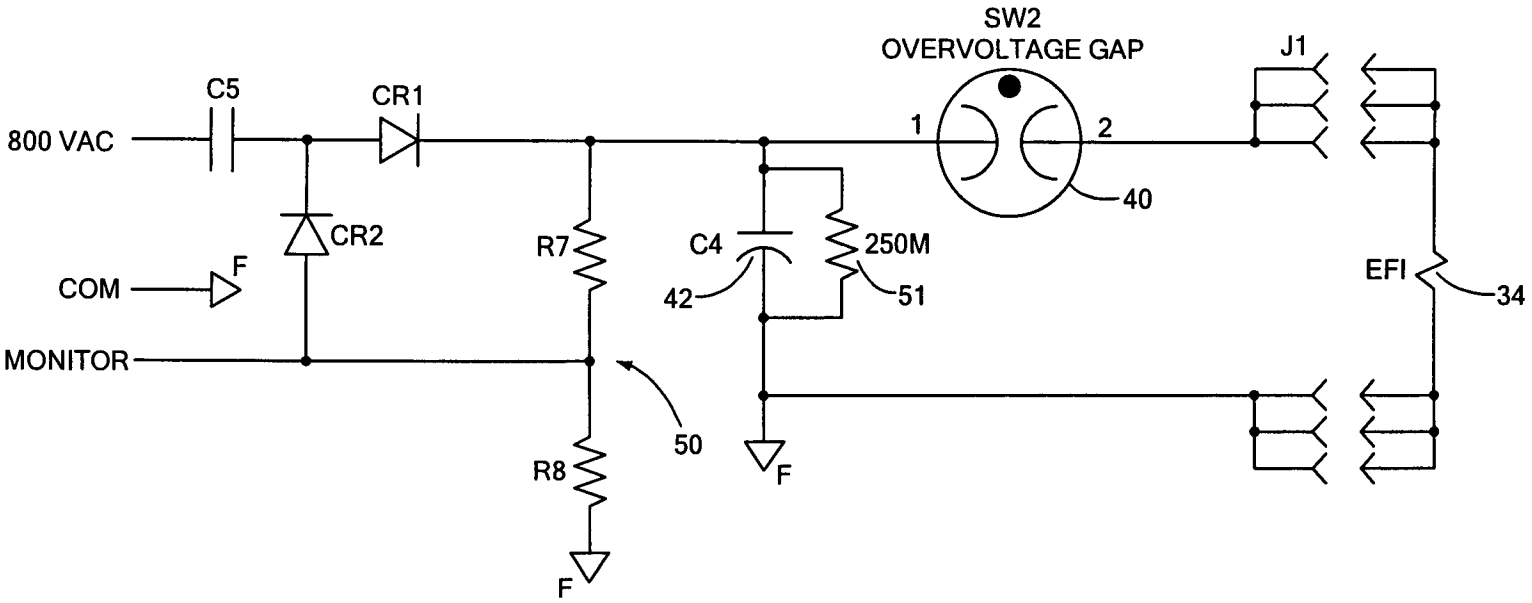
Figure 6:
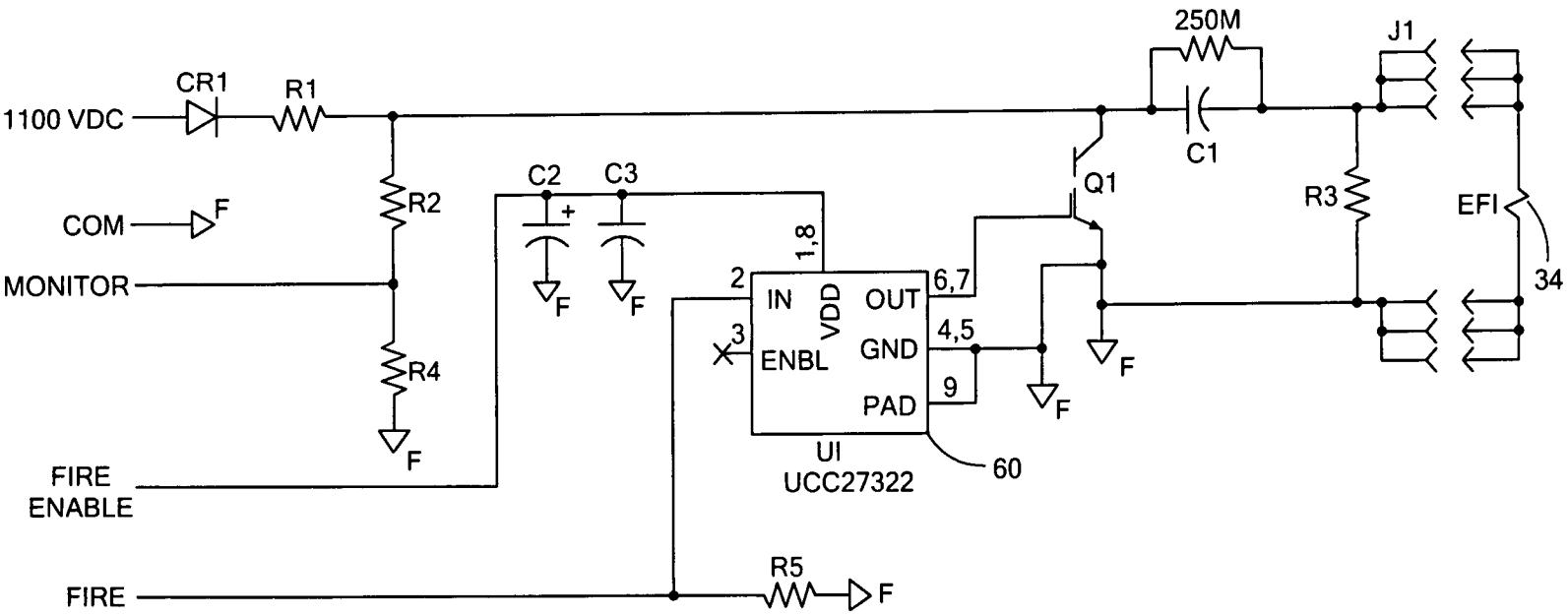
Figure 7:
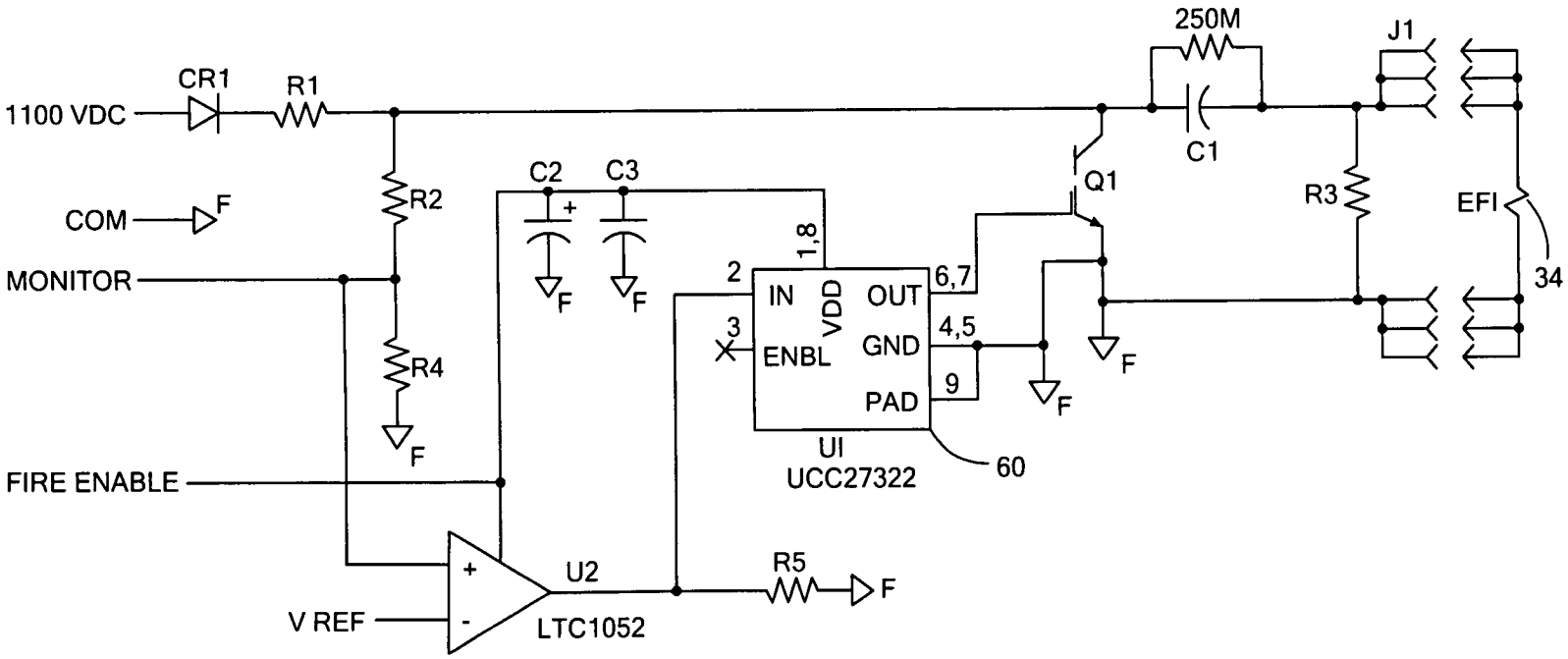

FIG. 5 shows another electronic configuration. This configuration is designed to take a lower AC voltage and multiply it (by a factor of 2) to arrive at a larger voltage. FIG. 6 shows a configuration incorporating a high voltage switch 60 such as a MOS Controlled Thyristor (MCT). The MCT 60 is off until driven to conduction by a gate driver. The gate driver requires an input voltage plus a trigger signal to drive the MCT. FIG. 7 shows a similar configuration to FIG. 6, except that the MCT 60 is automatically switched when the main charge capacitor reaches a predetermined voltage.

In this way, the long felt need for MIL-STD-1901A compliant high-voltage initiator is realized. The initiator is easily fitted into existing rocket motors, is fairly simple in design, and is easy to install.

Figure 8:
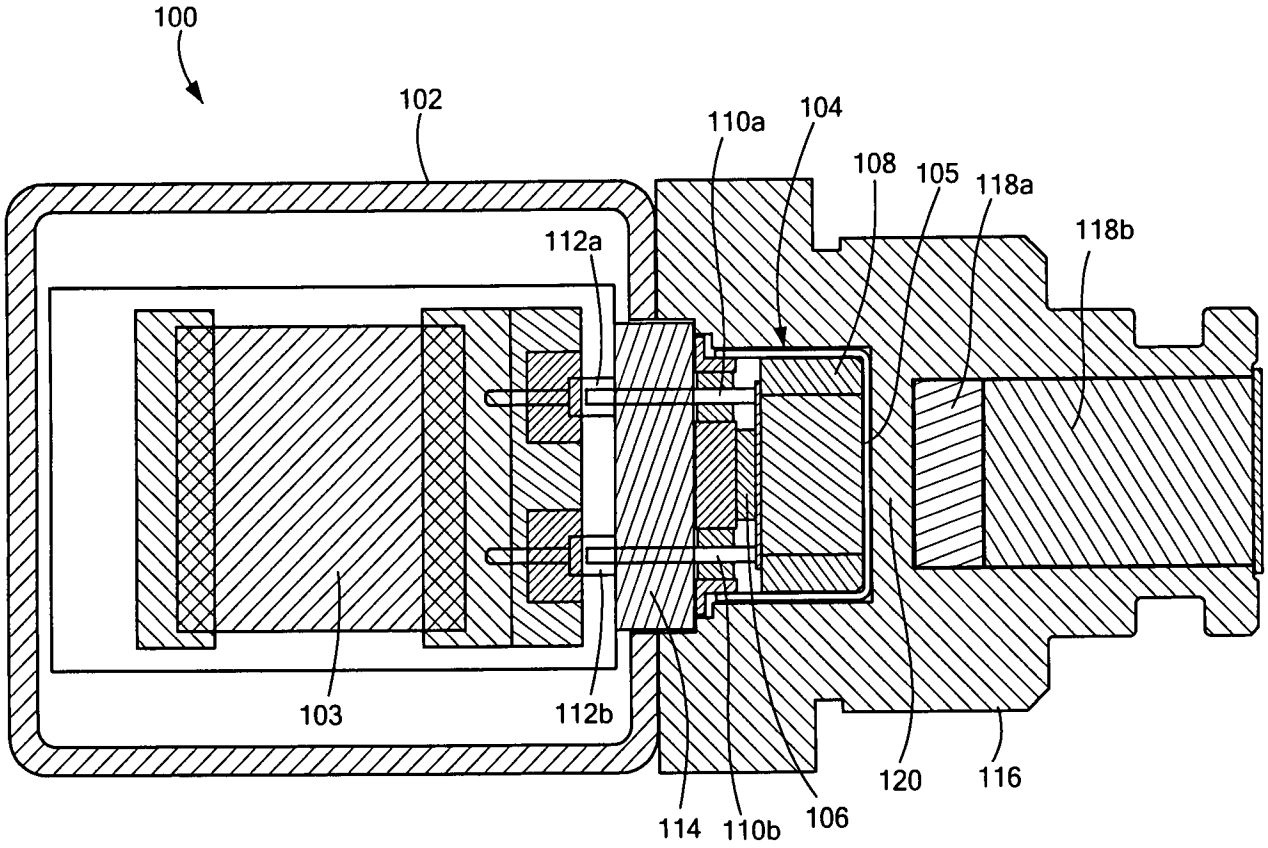
FIGS. 8-9 are schematic cross-sectional diagrams showing another example of an initiator in accordance with the subject invention.
Figure 9:
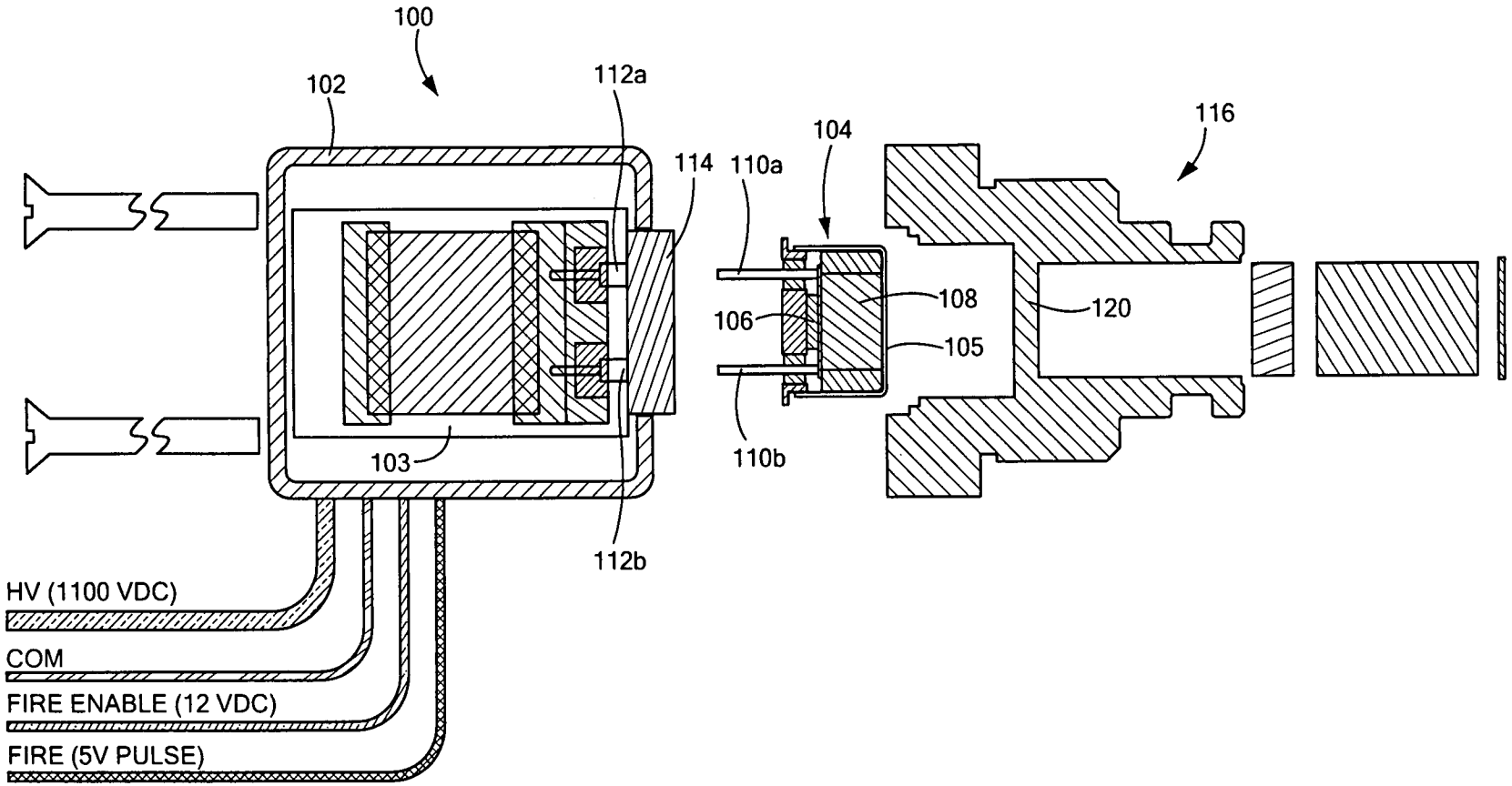

FIGS. 8-9 show an initiator 100 in accordance with another example. Housing portion 102 includes the over voltage protection circuitry 103 (see FIGS. 3-6). Electro-explosive device 104 with exploding foil initiator 106 and charge 108 (e.g., HNS-IV) at the distal end of housing portion 102 and within housing portion 105 is electrically connected to circuitry 103 via pins 110*a* and 110*b* received in sockets 112*a* and 112*b*, respectively, through pressure bulkhead 114.

This initiator assembly is received in igniter 116 which includes charge 118*a* (e.g., HNS-IV) and charge 118*b* (e.g., $BKNO_3$). When the proper voltage is applied to exploding foil initiator 106, charge 108 detonates and the resulting shock wave through igniter housing wall 120 detonates charge 118*a* which detonates charge 118*b*. In one design, housing portion 102 is integrated with housing portion 116.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. An initiator comprising:

a housing adapted to be received in an igniter or rocket motor;

at least one charge at a distal end of the housing;

an electro-explosive device behind the charge for detonating the charge when subject to a voltage;

a pressure bulkhead behind the electro-explosive device, and an electronic subsystem in the housing connected to the electro-explosive device through the bulkhead and including:

a lead for providing the voltage to the electro-explosive device to initiate it, and a switch in the lead which does not conduct if errant voltages are present on the lead to prevent initiation of the electro-explosive device until the correct voltage is present.

2. The initiator in claim 1 in which there are two charges in the distal end of the housing.

3. The initiator of claim 2 in which one charge is a pyrotechnic material and the other charge is a detonating material.

4. The initiator of claim 3 in which the pyrotechnic material includes BKNO.sub.3 and the detonating material includes HNS-IV.

5. The initiator of claim 1 in which the electro-explosive device is an exploding foil initiator.

6. The initiator of claim 1 in which the switch is a spark gap.

7. The initiator of claim 6 in which the electronic subsystem further includes a resistance in series with the spark gap for limiting current.

8. The initiator of claim 6 further including a capacitance charged by a voltage on the lead.

9. The initiator of claim 7 further including a resistance in parallel with the capacitance.

10. An initiator comprising:

a housing adapted to be received in an igniter or rocket motor;

at least one charge in the distal end of the housing;

an electro-explosive device behind the charge for detonating the charge when subject to a voltage;

a pressure bulkhead behind the electro-explosive device, and an electronic subsystem in the housing connected to the electro-explosive device through the bulkhead and including:

a lead for providing the voltage HV to the electro-explosive device to initiate it, and means for preventing errant voltages from initiating the electro-explosive device.

11. The initiator of claim 10 in which said means includes a spark gap.

* * * * *